United States Patent [19]

Feldmann et al.

[11] Patent Number: 4,813,257

[45] Date of Patent: Mar. 21, 1989

[54] APPARATUS FOR ROLLING BAR STOCK

[75] Inventors: Hugo Feldmann, Alsdorf-Warden; Hurbert Müller, Grevenbroich; Claus Schlanzke, Ratingen, all of Fed. Rep. of Germany

[73] Assignee: SMS Schloemann-Siemag AG, Dusseldorf, Fed. Rep. of Germany

[21] Appl. No.: 111,388

[22] Filed: Oct. 20, 1987

[30] Foreign Application Priority Data

Oct. 20, 1986 [DE] Fed. Rep. of Germany ..... 3635566

[51] Int. Cl.[4] ..... B21B 13/10; B21B 1/16; B21B 27/02

[52] U.S. Cl. ..... 72/199; 72/366

[58] Field of Search ..... 29/110, 121.1, 121.5, 29/125, 130; 72/199, 221, 224, 366

[56] References Cited

U.S. PATENT DOCUMENTS

| | | | |
|---|---|---|---|
| 4,537,054 | 8/1985 | Properzi | 72/224 |
| 4,674,312 | 6/1987 | Cook | 29/130 X |

FOREIGN PATENT DOCUMENTS

| | | | |
|---|---|---|---|
| 2524224 | 12/1976 | Fed. Rep. of Germany . | |
| 882671 | 11/1981 | U.S.S.R. | 72/224 |
| 1071336 | 2/1984 | U.S.S.R. | 72/199 |

*Primary Examiner*—E. Michael Combs
*Attorney, Agent, or Firm*—Herbert Dubno

[57] ABSTRACT

A star-shaped array of channeled rolls in a rolling mill for rolling bar stock has the rolls pressed together with a pressing force exceeding the rolling force by a prestressing force sufficient to cause frustoconical flanks of the rolls to forceably press against one another. This stabilizes the rolls and also permits a fine adjustment of the diameter of the passage defined between them.

9 Claims, 3 Drawing Sheets

APPARATUS FOR ROLLING BAR STOCK

FIELD OF THE INVENTION

My present invention relates to a method of and an apparatus for a rolling of bar stock with narrow tolerances and, more particularly, to a rolling method and apparatus which provides a channel or passage, using grooved, rolling-mill rolls, which is especially stable and can be precisely dimensioned or calibrated, e.g. for the finish rolling of round and other bar stock.

BACKGROUND OF THE INVENTION

From German patent document-open application DE-No. 0520 35 482 and German patent document - open application DE-OS No. 25 24 224, it is already known to form a caliber or rolling passage utilizing at least three grooved rolls in a star array so that the grooves of the rolls implied define a generally closed passage or caliber through which the workpiece passes during the rolling operation which is effective with a rolling force sufficient to deform the workpiece to the requisite extent.

In these patent publications, frustoconical flanks of the rolls can roll off one another so that a stable relationship between the set of rolls can be formed to increase the rolling throughput and/or increase the average reduction which can be effected in the particular set of rolls or mill stand.

A disadvantage has been noticed with such systems. From time to time the caliber or passage may be incompletely filled, e.g. as a result of the irregularity of the oncoming workpiece or some characteristic of the flow of the metal thereof, so that the workpiece is incompletely shaped.

Occasionally, the volume of the material which is forced to pass through the passage is greater than that which can be accommodated, i.e. the caliber or passage is overfilled, and the rolled profile or shape is found to have ribs extending axially along the periphery where there was incomplete junction of the grooved surfaces of the rolls. In all of these cases, the rolling force is maintained.

The rolling force is a force which can be determined, e.g. through experiment, and can be ascertained for bar stock of different dimensions, reductions of different degrees, various compositions of materials and different temperatures of the workpieces rolled. Generally the rolling force is that required, as indicated previously, to bring about the desired reduction in the workpiece or billet or semirolled product which is to be given the desired final dimensions and efforts are made not to exceed this rolling force because any increase above the rolling force is presumed to increase the wear of the apparatus.

OBJECTS OF THE INVENTION

It is the principal object of the present invention to provide an improved rolling mill for the rolling of workpieces into bar stock of desired cross section and dimensions with high precision, i.e. low tolerances, without the drawbacks enumerated above, i.e. without the formation of flashing ribs and the incomplete profiling of the product, and without the danger that alternating frame expansion and contraction of the mill and fluctuations in the dimensions of the structure thereof will have an adverse effect on the precision or the cross sectional configuration of the product.

It is another object of this invention to provide an improved rolling method with similar advantages.

SUMMARY OF THE INVENTION

These objects and others will become apparent hereinafter are attained, in accordance with the present invention by a method of rolling bar stock which comprises juxtaposing in a star-shaped array at least three rolls having rolling peripheries formed with respective circumferential shaping or caliber grooves collectively defining a closed periphery passage or caliber of a cross section and dimensions to be formed in high precision in a workpiece. The rolls also have each a pair of frustoconical flanks converging outwardly away from the respective rolling periphery.

An elongated workpiece is passed through the passage or caliber and is rolled on its pass therethrough with the rolls while the rolls apply a rolling force ($F_w$) to the workpiece to roll the same to the desired cross section and dimension.

According to the invention, each of the rolls is pushed toward the workpiece during the rolling thereof so that juxtaposed pairs of the flanks of adjacent ones of the rolls forceably abut. The pushing or applied force ($F_a$) exceeds the rolling force ($F_w$) by a prestressing force ($F_v$) under the effect of which the pairs of flanks abut directly upon and roll against one another to stabilize the shape and dimensions of the caliber or passage. The prestressing force ($F_v$) is sufficient to maintain this contact and partially deform each of the rolls against the others under all conditions of the rolling operation and in spite of force-induced, vibration-induced and temperature-induced frame expansions and other fluctuations in the support of the rolls.

Thus the present invention provides that the objects set forth are achieved by providing a pushing force to the rolls in the direction of the center of the passage or caliber of such magnitude that it exceeds the rolling force by an amount which constitutes a prestressing force with which abutting frustoconical flanks of the adjacent rollers bear upon one another. The peripheries of the rolls are thus stabilized by their mutual bearing force and define the closed passage by the effect of the prestressing force as the rolls roll upon one another.

On the one hand, the largely constant pushing force suppresses the effect of frame expansion and like dimensional changes because the prestressing force has a magnitude greater than any relaxation in the pushing force which such dimensional changes can create so that the overall assembly is relatively stiff and rigid. This means that if there are fluctuations, they are to be observed only as variations in the prestressing force which is taken up by the elastic deformation and compression of the rolls themselves.

On the other hand, because it is possible to vary the pushing force and hence the extent of this intrinsic deformation of the rolls, it is also possible to utilize the pressing force via fine adjustment of the closed passage defined between the rolls and thus the dimensions and configuration of this passage and the dimensions and shape of the rolled product.

The rolling is largely independent of any yielding of the frame and the steep spring characteristics of the latter, while nevertheless permitting a fine adjustment of the caliber or passage diameter in a simple manner. In this case, of course, the prestressing force becomes a measure of the dimensions of the passage for thickness control of the rolled stock.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
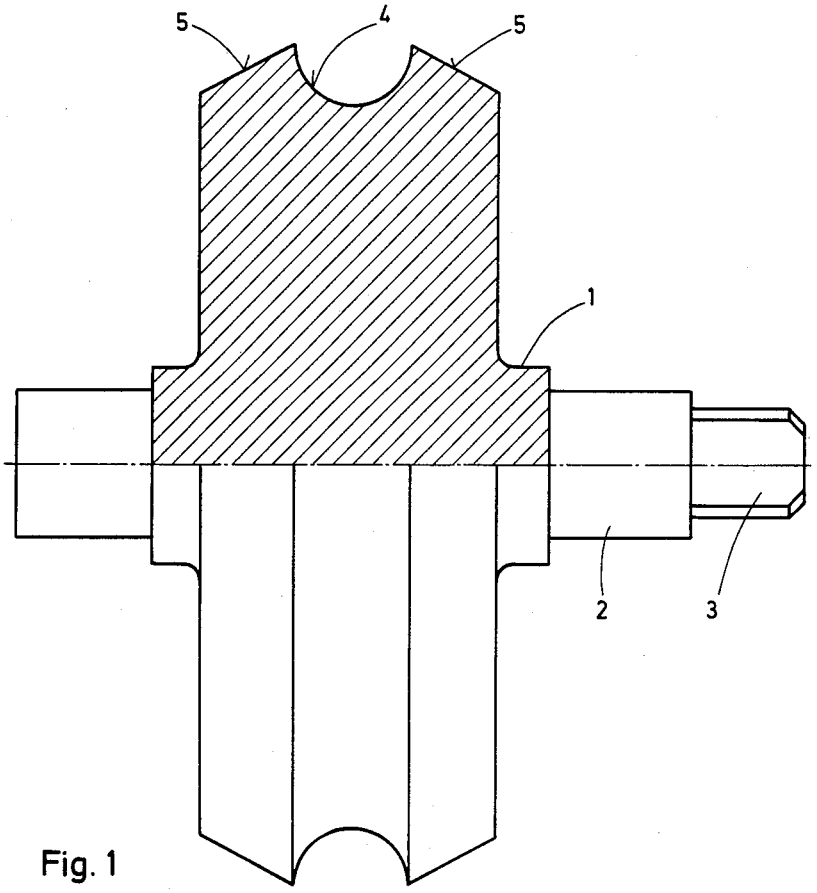
FIG. 1 is a diagram of a mill roll according to the invention for a four-roll set, partly in cross section and partly in elevation.

FIG. 1 is a partial section of a working roll 1 for a four-roll mill set. The roll has a pair of shaft stubs 2, one of which can be extended into a drive stub 3 which can be coupled with a drive motor. The periphery or rim of the roll is formed with a caliber groove 4, i.e. a circumferential shaping groove, and with a pair of frustoconical flanks 5 along the periphery as well. The frustoconical flanks converge outwardly away from the respective shaping groove.

Such rolls and rolling mill frames provided with them are known from the patent publications mentioned earlier in themselves. The rolls are oriented in a star-shaped array in the prior art so that their frustoconical surfaces are closely juxtaposed but generally spaced slightly apart so as to make the rolls individually adjustable. Experience has shown, with such roll sets, however, that the finished product will have ribs along the length resulting from a deformation of the material of the workpiece or stock between the rolls.

According to the invention and in contrast to the prior art system, the frustoconical flanks 5 of the neighboring rolls are pressed against one another with a strong prestressing force that allows at least a slight deformation of the body of the roll, e.g. a compression so that the prestressing force and the forcible direct contact will be maintained under all conditions of operation of the mill.

In that case, a practically completely closed caliber or passage is obtained and no material can be pressed any longer between the flanks of the rolls. The aforementioned ribs simply do not form. Furthermore, the fact that the pushing force greatly exceeds the rolling force ensures a practically automatic compensation for framing expansion and other dimensional variations.

If, as a result of a reduced temperature of the workpiece, there arises an increased rolling force, this does not result in an expansion of the roll set since it cannot overcome the prestressing force.

When the rolling force then does increase, against a generally constant pushing force, only the prestressing force will be reduced to a certain extent.

By controlling this prestressing force and hence the degree of deformation of the rolls, we are able, in addition, to bring the rolls together slightly, with a certain degree of flattening of the periphery, thereby regulating the dimensions of the passage to a limited extent.

Figure 2:
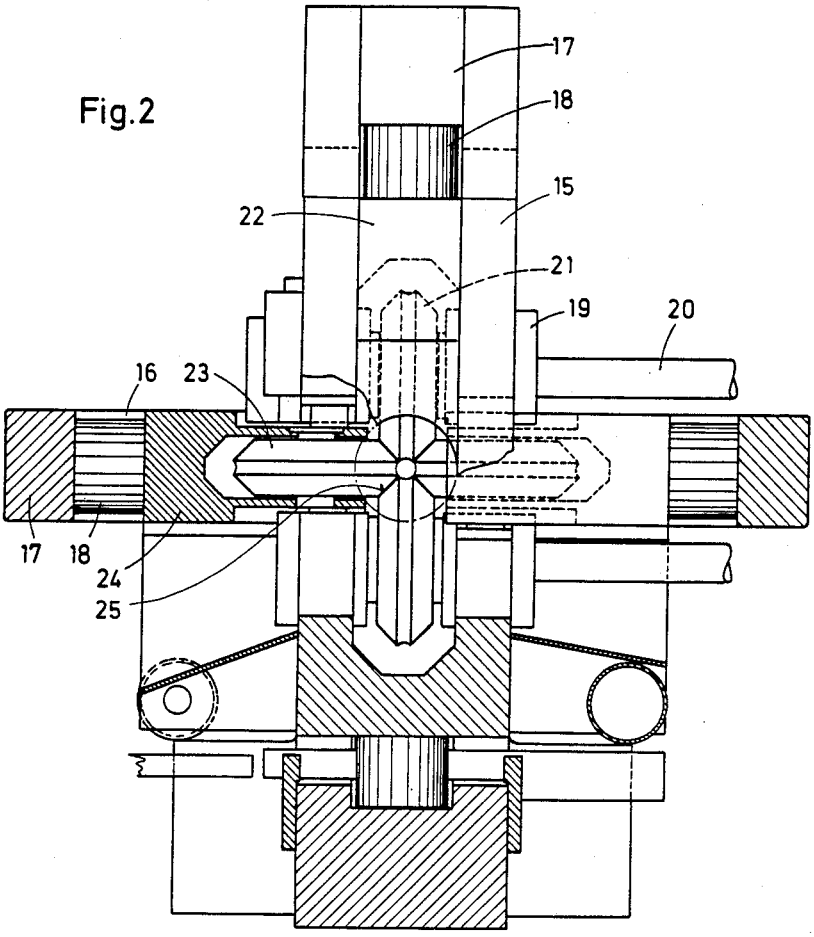
FIG. 2 is a front view of a rolling mill for the production of round stock using a four-roll set, partly broken away and with parts in section.

In FIG. 2 we have shown a frame for a set of rolls 21, 23. The frame here comprises the usual vertical mill stand uprights 15 and laterally cantilevered beams 16. The vertical uprights or beams 15 and the horizontal beams 16 are bridged by yokes 17, each of which carries a hydraulic pushing device 18 which can include a hydraulic actuator beaming upon members 22 and 24 carrying the shafts of the respective rolls and applying respectively vertical and horizontal forces to the rolls 21 which have horizontal axes and are rotatable in a vertical plane, and the rolls 23 which have vertical axes and are rotatable in a horizontal plane.

Both horizontal-axis rolls 21 are driven by coupling the shafts thereof to drive spindles 20. The pressure members 22 act upon roll-carrying guides 19 of the horizontal-axis roll 21.

The vertical-axis rolls 23 are thus driven by friction by entrainment with the frustoconical surfaces of the driven rolls under the prestressing force which presses the juxtaposed pairs of frustoconical surfaces 25 together. If necessary, the vertical axis rolls can be provided with drive spindles as well.

In operation, the actuators 18, which can hydraulic cylinder arrangements, press the rolls inwardly with a pressing force which exceeds the requisite rolling force by a prestressing force which is sufficient to bring the juxtaposed frustoconical surfaces into direct contact. The directly driven rolls 21 frictionally entrain the rolls 23 to roll a workpiece as it passes through the circular passage P defined by the grooves of the rolls (see FIG. 1).

The arrangement can be modified in that, of course, the number of rolls need not be limited to four, but can be three, five or more rolls. The rolls in all cases, should be pressed against each other with the prestressing force mentioned previously which stabilizes the roll set. If thicker, harder and/or colder workpieces are engaged between the rolls, so that a higher rolling force is required, the roll set is not spread apart and rather the reserve to maintain the resulting force is supplied by the prestressing force and an uncontrolled enlargement of the passage will not occur.

The loading of the frame remains substantially constant because the pushing force need not be varied under these circumstances.

We can measure the thickness of the product and in a feedback system increase the pressing force to obtain a slight additional reduction in the workpiece diameter if desired, by increasing the prestressing force and hence the degree of flattening of the frustoconical peripheral regions of the rolls in contact with one another. That will, of course, reduce the diameter of the passage.

Figure 3:
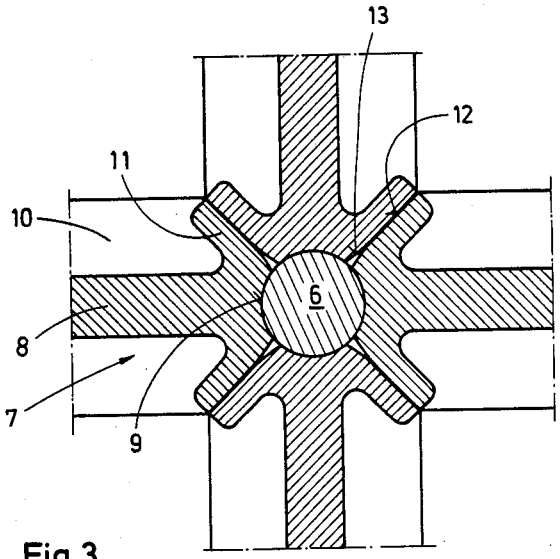
FIG. 3 is a cross section diagrammatically illustrating the cooperation of four rolls in a preferred embodiment thereof.

If one uses rolls of the type shown in FIG. 3 wherein the passage 6 is defined by four rolls 7, each of which has an undercut 10 behind the respective frustoconical flank 11, the deformability of the roll periphery can be increased.

In this case the roll has a disk-shaped web 8 along the peripheral portion of which the caliber groove 9 is formed. The undercuts 10 are provided behind and on opposite sides of the body formed with the groove to generate wings 11 forming the frustoconical surfaces. The mutually contacting portions of these frustoconical surfaces, which have straight-line generatrices meeting in the center of the passage, are represented at 12 and are pressed together with the prestressing force mentioned earlier.

From these contacting regions, the generatrix may deviate from the straight-line generatrix to reduce the inclination toward the groove 9 over setback regions 13. The setback regions are exaggerated in FIG. 3. When the prestressing force is increased, these regions can be brought into direct contact with one another to reduce the diameter of the passage. Furthermore, any crevice formed by these regions can be so small as to preclude the extrusion of the stock into these crevices by the rolling force. The undercutting of the wings 11 increases their elasticity to improve the range of control of the diameter of the passage.

Figure 4:
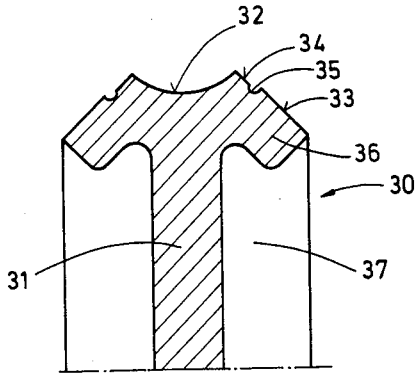
FIG. 4 is a cross sectional view through a portion of the periphery of a modified roll.

As has been shown in FIG. 4, the elasticity of the contacting regions may be improved for a roll body 30 having a disk-shaped web 31 in the radial extension of which the groove 32 is formed, by providing a setback region 34 directly adjoining the groove and, between this setback region 34 and the frustoconical surface 33 of the wing 36 formed by the undercut 37, a recess 35 which preferably is a cutout of semicircular cross section. The recesses 35, which are grooves extending between the circumferentially shaping grooves and the abutting frustoconical flanks decouple the abutment surfaces from the shaping surfaces, increase the elasticity of the abutting surface regions and thus provide the stabilization under the prestressing force previously described to permit an increased range of adjustment of the passage and also freedom from sensitivity to expansion of the structure because of increased rolling forces.

We claim:

1. An apparatus for rolling bar stock, comprising:

a mill frame;

a star-shaped array of at least three rolls mounted in said frame, each of said rolls formed with a peripheral surface bearing upon one another and defining a closed-periphery passage of a workpiece to be rolled, each of said being rolls provided with a rim formed with a circumferential shaping groove, said shaping grooves of the rolls of said array collectively delimiting said closed-periphery passage and defining a cross section and caliber of the workpiece to be rolled, a generally cylindrical web extending radially inwardly from the respective rim, and a pair of frustoconical wings having outwardly facing contact surfaces diverging axially outwardly away from the respective shaping groove and inwardly facing surfaces diverging axially outwardly away from the web, each of said inwardly facing surfaces being separated from a juxtaposed region of the respective web by a respective undercut; and means for urging each of said rolls toward said workpiece to be rolled, so that said contact surfaces of adjacent rolls being juxtaposed with one another are forcibly abutted directly and roll against one another, each two adjacent contact surfaces forming at least in a region of abutment respective straight-line generatrices passing through the same point in said passage upon extension, at least one of said contact surfaces being slightly set back from the respective generatrix adjacent the respective shaping groove so that said rolls upon being urged against one another with an applied force ($F_a$) exceeding a rolling force ($F_w$) applied to said workpiece by a prestressing force ($F_v$) causing said contact surfaces to abut one another, have said wings increased deformability at said wings improving stabilization of the shape and dimensions of said passage.

2. The apparatus defined in claim 1 wherein each of said contact surfaces is formed with a recess adjacent said region of abutment.

3. An apparatus defined in claim 1 wherein said webs are disk-shaped webs.

4. The apparatus defined in claim 1 wherein said wings have outer surfaces including angles of 360°/n wherein n is the number of rolls delimiting the passage.

5. The apparatus defined in claim 1 wherein adjacent each groove, the periphery of respective rolls is set back from the straight line generatrices of the respective flanks.

6. The apparatus defined in claim 5 wherein a recess is provided between each of said flanks and the setback.

7. The apparatus defined in claim 1 wherein a region between each flank and the respective groove is provided with a flatter angle of inclination that the generatrices of the respective flanks.

8. The apparatus defined in claim 1 wherein four such rolls are provided in said array.

9. The apparatus defined in claim 8 wherein two of said rolls are provided with means for driving same, the other two rolls being frictionally entrained by the driven rolls.

* * * * *